US011745243B2

(12) United States Patent
Watchorn et al.

(10) Patent No.: US 11,745,243 B2
(45) Date of Patent: Sep. 5, 2023

(54) MULTI-AXIS ROLL-FORMING OF STEPPED-DIAMETER CYLINDER

(71) Applicant: Inno-Spin LLC, Phillipsburg, NJ (US)

(72) Inventors: Doug Watchorn, Frenchtown, NJ (US); Michael Nasson, Raritan, NJ (US); Maximilian Linder, Phillipsburg, NJ (US); Brian Ford, Moseley, VA (US); Robert Chrouch, Nazareth, PA (US)

(73) Assignee: Inno-Spin LLC, Phillipsburg, NJ (US)

( * ) Notice: Subject to any disclaimer, the term of this patent is extended or adjusted under 35 U.S.C. 154(b) by 0 days.

(21) Appl. No.: 17/669,212

(22) Filed: Feb. 10, 2022

(65) Prior Publication Data

US 2022/0203422 A1 Jun. 30, 2022

Related U.S. Application Data

(63) Continuation of application No. 16/586,046, filed on Sep. 27, 2019, now Pat. No. 11,298,734.

(Continued)

(51) Int. Cl.

| | |
|---|---|
| ***B21D 5/08*** | (2006.01) |
| ***B21D 39/03*** | (2006.01) |
| ***B21D 22/16*** | (2006.01) |

(52) U.S. Cl.

CPC ..... *B21D 5/086* (2013.01); *B21D 22/16* (2013.01); *B21D 39/03* (2013.01)

(58) Field of Classification Search

CPC ..... B21D 19/04; B21D 19/046; B21D 22/14; B21D 22/16

(Continued)

(56) References Cited

U.S. PATENT DOCUMENTS 3,282,078 A * 11/1966 Kaesemeyer ..... B21D 22/18 29/892.2
4,455,852 A * 6/1984 Paton ..... B21D 22/14 72/82

(Continued)

FOREIGN PATENT DOCUMENTS

CN 106694665 A 5/2017
DE 102010000004 A1 * 7/2011 ..... B21D 41/02

(Continued)

OTHER PUBLICATIONS

PCT/US2019/053483 International Search Report and Written Opinion dated Feb. 6, 2020, 10 pages.

(Continued)

*Primary Examiner* — Shelley M Self
*Assistant Examiner* — Jared O Brown
(74) *Attorney, Agent, or Firm* — Cozen O'Connor

(57) ABSTRACT

A multi-axis roll-forming system for forming a stepped diameter in a cylinder includes a support that spins about a rotation axis while supporting a workpiece that includes the cylinder. A first actuator translates a first roller perpendicularly to the rotation axis. A second actuator moves a multi-axis roller radially outward, relative to the rotation axis, and upward along the rotation axis. The system may also include a first roller arm to which the multi-axis roller is coupled. The first roller arm is connected to a pivot joint having a pivot axis that is perpendicular to the rotation axis. The second actuator may include a linear-drive actuator that is coupled to the first roller arm and extends along the rotation axis to force the multi-axis roller to pivot about the pivot axis.

9 Claims, 13 Drawing Sheets

Related U.S. Application Data

(60) Provisional application No. 62/737,511, filed on Sep. 27, 2018.

(58) Field of Classification Search
USPC ..... 72/83–86
See application file for complete search history.

(56) References Cited

U.S. PATENT DOCUMENTS

| | | | | |
|---|---|---|---|---|
| 4,781,047 | A | 11/1988 | Bressan et al. | |
| 6,161,410 | A | 12/2000 | Shook et al. | |
| 7,124,609 | B1 * | 10/2006 | Hermanson | B21D 22/16 72/82 |
| 8,533,957 | B2 | 9/2013 | Spurlock et al. | |
| 8,726,708 | B2 | 5/2014 | Sato et al. | |
| 8,763,438 | B2 | 7/2014 | Sato et al. | |
| 2015/0367394 | A1 * | 12/2015 | Jung | B21D 19/02 72/460 |
| 2016/0245437 | A1 * | 8/2016 | Eriksson | B21D 41/02 |
| 2017/0274443 | A1 | 9/2017 | Kobayashi et al. | |
| 2019/0374991 | A1 | 12/2019 | Nillies | |

FOREIGN PATENT DOCUMENTS

| | | | | | |
|---|---|---|---|---|---|
| DE | 102010000004 | A1 | | 7/2011 | |
| JP | 3264613 | B2 | | 3/2002 | |
| JP | 2015221443 | A | * | 12/2015 | |
| KR | 20110129058 | A | | 12/2011 | |
| KR | 10-0929221 | B1 | | 12/2019 | |
| WO | WO-0220192 | A2 | * | 3/2002 | B21D 22/16 |
| WO | WO 0220192 | A2 | | 3/2002 | |
| WO | WO 2017199425 | A1 | | 11/2017 | |

OTHER PUBLICATIONS

PCT/US2019/053493 International Search Report and Written Opinion dated Feb. 24, 2020, 11 pages.

PCT/US2019/053483 Invitation to Pay Additional Fees dated Nov. 14, 2019, 2 pages.

PCT/US2019/053493 Invitation to Pay Additional Fees dated Nov. 14, 2019, 2 pages.

Chinese Patent Application No. 201980063821.0, Office Action dated Oct. 28, 2022, with English translation, 18 pages.

* cited by examiner

MULTI-AXIS ROLL-FORMING OF STEPPED-DIAMETER CYLINDER

CROSS-REFERENCE TO RELATED APPLICATIONS

This application is a continuation of U.S. patent application Ser. No. 16/586,046, filed Sep. 27, 2019, which claims the benefit of priority from U.S. Provisional Patent Application No. 62/737,511, filed Sep. 27, 2018. Each of these applications is incorporated herein by reference in its entirety.

FIELD

The method, system and apparatus disclosed herein relates to roll-forming of metal parts.

BACKGROUND

The metalworking industry is striving toward producing metal parts that are stronger, lighter, more accurate, and cheaper. Roll-forming is one method that has proven advantageous in this regard. Roll forming uses a set of rollers to bend thin metal to achieve a desired shape. Most commonly, a coil of sheet metal is fed into a roll-forming machine that, as the coil is advanced through the machine, forces a series of rollers against the coil to change its shape. In a simple example, rollers are pressed against the sides of a coil to change the profile of the coil from planar to u-shaped. More advanced shapes may be imparted using other roller configurations. The roll-formed coil may be cut into sections of a desired length. In some instances, two ends of a section are joined to make a roll-formed ring.

Roll-forming may be entirely automated and performed at a high throughput rate, thus resulting in low manufacturing cost. In addition, since roll-forming works the metal in a cold state, the roll-formed parts are generally stronger than hot-worked parts made from metal of similar thickness. For example, roll-forming may be superior to extrusion in terms of strength of the finished part. As a result, a roll-formed part may be made from thinner metal and yet be as strong as a similar part made by extrusion, which leads to savings in material cost as well as lighter finished parts.

SUMMARY

The present disclosure provides an improved method of manufacturing a roll-formed component. The system and method disclosed herein is a significant improvement over the currently known methods which usually involve a stamping operation having several steps requiring dedicated stamping equipment and result in a significant amount of scrap. The method of the present disclosure involves the use of a sheet of steel, which is the usual material of which many roll-formed components are fabricated. The method of the present disclosure thus provides an improvement from a material use and efficiency point of view.

Disclosed herein is a multi-axis roll-forming method for forming a stepped diameter in a cylinder. The method comprises spinning the cylinder with a first diameter about a rotation axis encircled by the cylinder. During the step of spinning, a first roller is translated radially outward, relative to the rotation axis, against an inward-facing surface of a lower portion of the cylinder to angle the lower portion radially outward. After the step of translating, at least one multi-axis roller is moved radially outward and upward against the inward-facing surface, is angled radially outward and presses the lower portion against an anvil so as to shape the lower portion into a cylindrical wall having a second diameter that is greater than the first diameter. In addition a ledge is formed connecting the cylindrical wall characterized by the second diameter to an upper portion of the cylinder characterized by the first diameter.

The multi-axis roll-forming system disclosed herein also forms a stepped diameter in a cylinder. The roll-forming system includes a support configured to spin about a rotation axis while supporting a workpiece such as a cylinder. A first actuator is configured to translate a first roller perpendicular to the rotation axis. A second actuator is configured to move at least one multi-axis roller radially outward, relative to the rotation axis, and upward along the rotation axis.

Additionally, disclosed herein is a stepped-diameter cylinder fabricated by multi-axis roll-forming. The stepped-diameter cylinder includes a first cylindrical wall characterized by a first diameter and having a first material thickness. The cylinder also includes a second cylindrical wall characterized by a second diameter and having the same material thickness as the first cylindrical wall. The second cylindrical wall is also concentric with the first cylindrical wall. The cylinder also includes a ledge perpendicular to the cylinder axis of the first cylindrical wall and connects a bottom edge of the first cylindrical wall with a top edge of the second cylindrical wall. A bend exists between the ledge and the first cylindrical wall having the same material thickness as the first material thickness to within a few percent. The first cylindrical wall, the ledge, and the second cylindrical wall are fabricated from respective portions of a single continuous part.

DETAILED DESCRIPTION

Multi-Axis Roll-Forming Method A

Figure 1A:
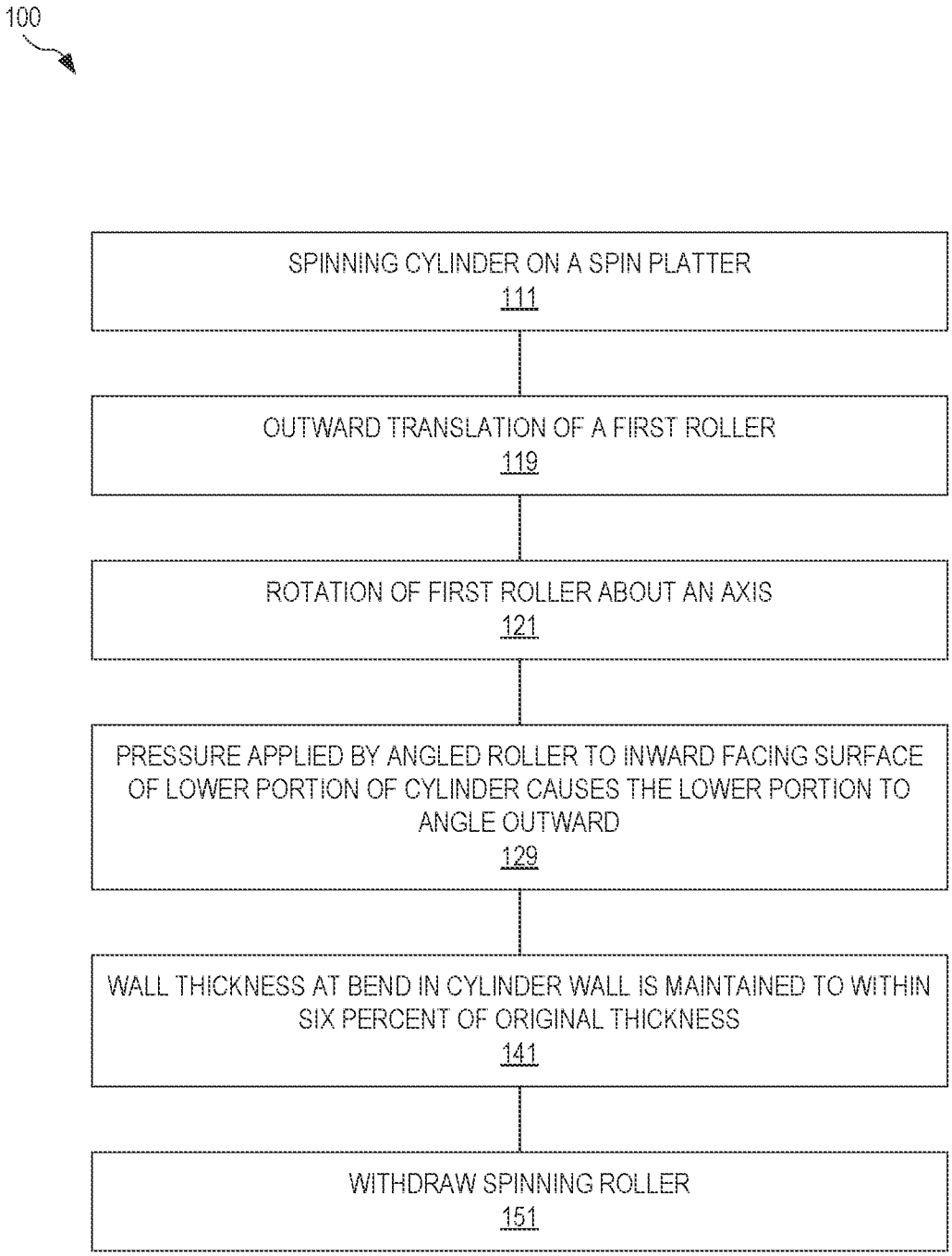
FIGS. 1A-B show a flowchart for a multi-axis roll-forming method of a stepped diameter cylinder, according to an embodiment.
Figure 1B:
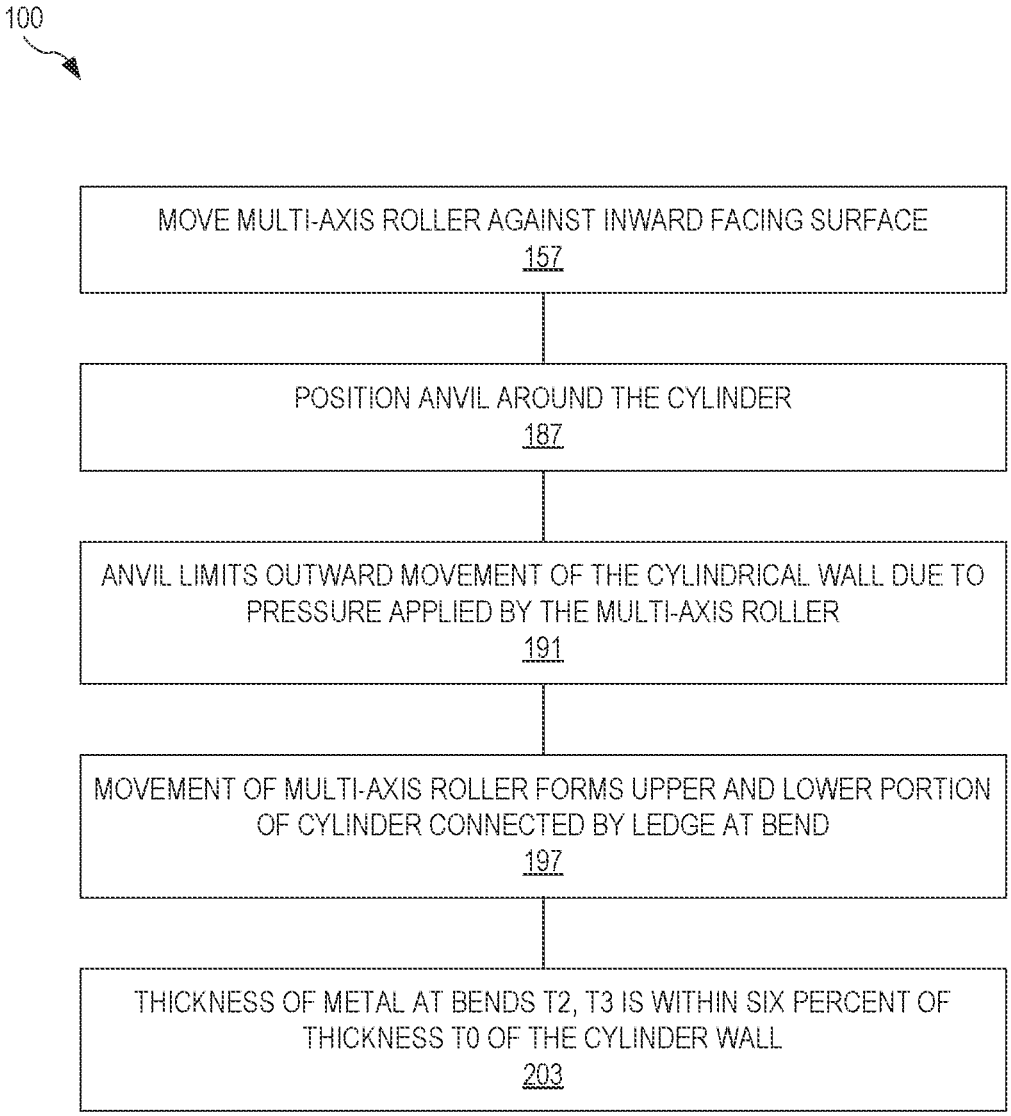

FIGS. 1A-1B illustrates a logic flow diagram detailing a multi-axis roll-forming method 100 of a ring shaped metal workpiece 110. Method 100 details multi-axis roll-forming of a stepped diameter in a cylinder 112 (see FIG. 2). The method in general is set forth in the flow diagrams of FIGS. 1A and 1B. A more detailed description of the roll-forming method is also set forth further below, however; a cursory description of the steps of the method follows immediately to provide the reader with a general background on the method steps disclosed herein.

FIG. 1A provides that the roll forming operation requires spinning 111 the workpiece cylinder 112, with an inner diameter D1, about a rotation axis 114 on a spin platter 113. A repositionable support flange 116 retains and supports the lower edge 118 of the cylinder 112 in position during rotation. Next, there is an outward translation 119 of the first roller and rotation of the first roller about an axis 121. FIG. 1A further reveals the step of the application of pressure 129 by an angled roller against the inward facing surface of the lower portion of the cylinder in order to cause the lower portion of the cylinder to angle outward.

The outward angling of the lower portion of the cylinder by the roller results in a change in wall thickness at the bend that is no more than a six percent change 141 in the wall thickness prior to the forming operation. FIG. 1A details that the next step is the withdrawal 151 of the spinning roller. Following the withdrawal of the spinning roller as outlined in FIG. 1B, the next step is to move 157 (see FIG. 1B) a multi-axis roller against an inward facing surface of the cylinder and then to position 187 an anvil around the cylinder. The anvil restricts outward movement 191 of the cylindrical wall due to the pressure applied to the wall by the multi-axis roller. It is the movement of the multi-axis roller that forms 197 (see FIG. 1B) the upper and lower portions of the cylinder that are connected by a ledge at the bends in the cylinder wall. This forming of the cylinder wall, as with the previously detailed bending of the cylinder wall, results in a metal thickness at the bend that is within six percent of the thickness of the metal prior to the forming operation 203.

Figure 2:
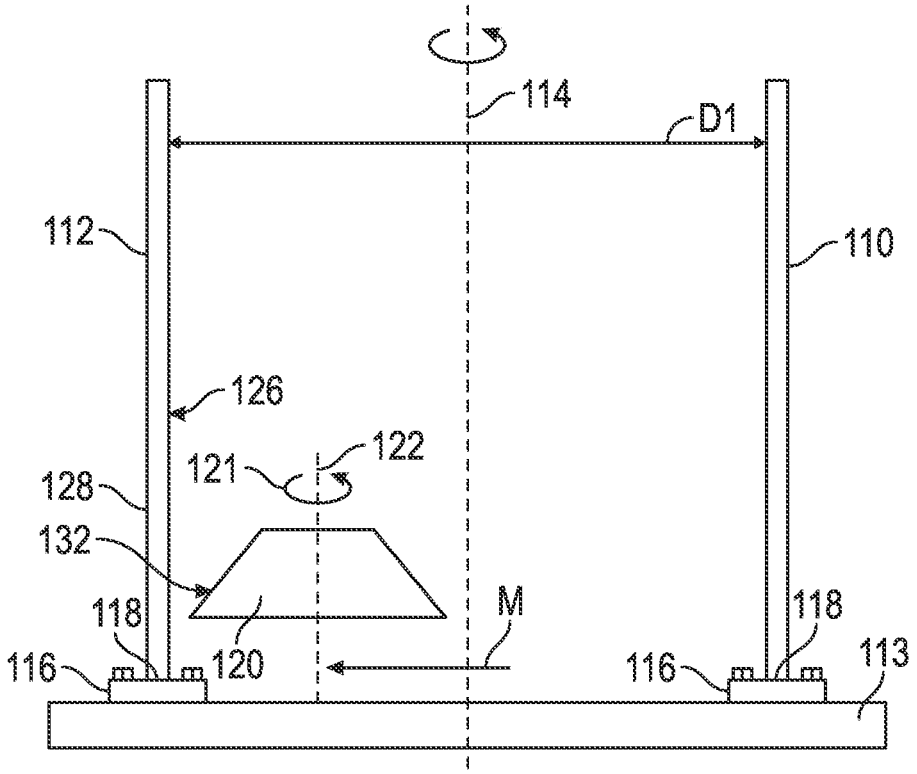
FIG. 2 illustrates a roller positioned adjacent to an inward facing surface of a cylinder, according to an embodiment.
Figure 3:
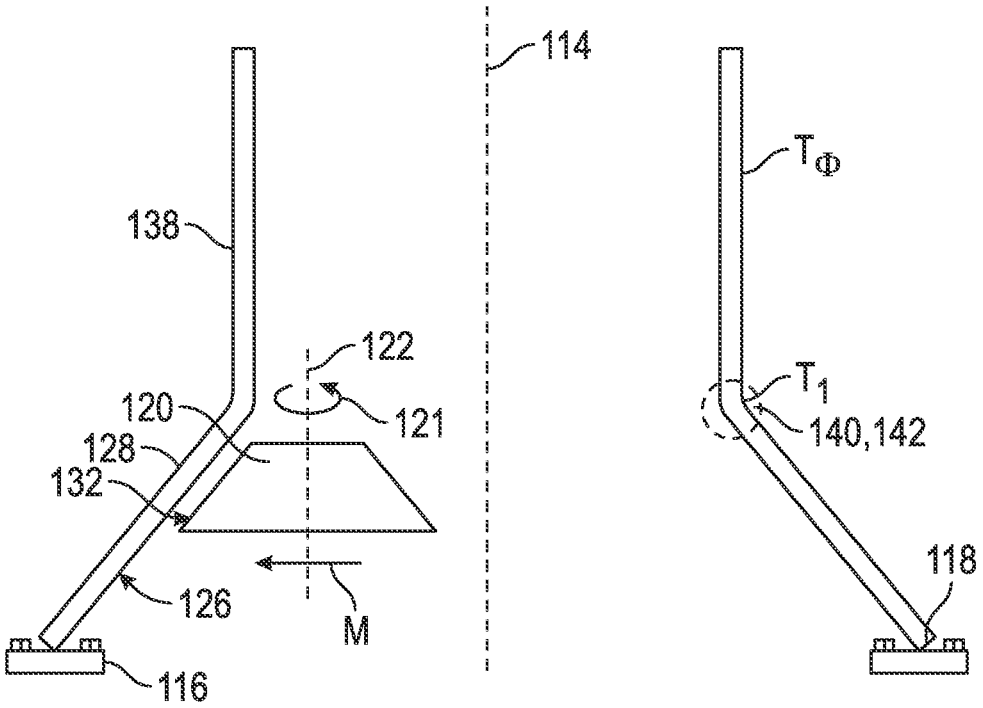
FIG. 3 illustrates the roller of FIG. 2 moving outward against the inward facing surface of the cylinder to form the lower portion of the cylinder.

FIG. 2 reveals the preparatory stages of a radially outward translation M of a first roller 120. This radially outward translation is relative to the rotation axis 114. The first roller 120 rotates 121 (see also FIG. 1A) about an axis 122 that is parallel with and displaced from the rotation axis 114 of the spin platter 113. As seen in FIG. 3, the spinning roller 120 translates outward, as directionally indicated by reference letter M, against an inward-facing surface 126 of a lower portion 128 of the cylinder 112 to angle 129 (see FIG. 1A) the lower portion 128 radially outward. To accomplish this forming operation the spinning roller 120 utilizes a canted surface 132 that is shaped as a truncated cone, thereby causing the lower portion 128 to angle radially outward, relative to the rotation axis 114.

As seen in FIG. 3, the radially translating movement of the spinning roller 120 shapes the lower portion 128 into a truncated cone connected to the upper portion 138 at a circular inflexion line 140 encircling the rotation axis 114. The forming method disclosed herein maintains 141 (see FIG. 1A) the wall thickness $T_1$ at the bend 142 in the metal at the circular inflexion line 140 connecting the lower portion 128 and the upper portion 138 to within six percent of the original wall thickness $T_0$ of the cylinder prior to the forming operation previously described. This nominal change in the thickness of the wall $T_1$ maintains the strength of the metal at the bend 142 and thereby improves the durability of the components shaped with this roll-forming process.

The support flange 116, as noted above, is infinitely repositionable within a certain range of distances from rotation axis 114 in order to allow the diameter of the lower edge 118 of the workpiece cylinder 112 to increase with increasing outward pressure from the spinning roller 120. The support flange 116 may be spring loaded and sectional in configuration to allow for expansion of the lower edge 118 of the cylinder 112 that is undergoing the forming operation. Other mechanical options are well known in the art and are capable of facilitating a uniform increase in the diameter of the lower edge.

Figure 4A:
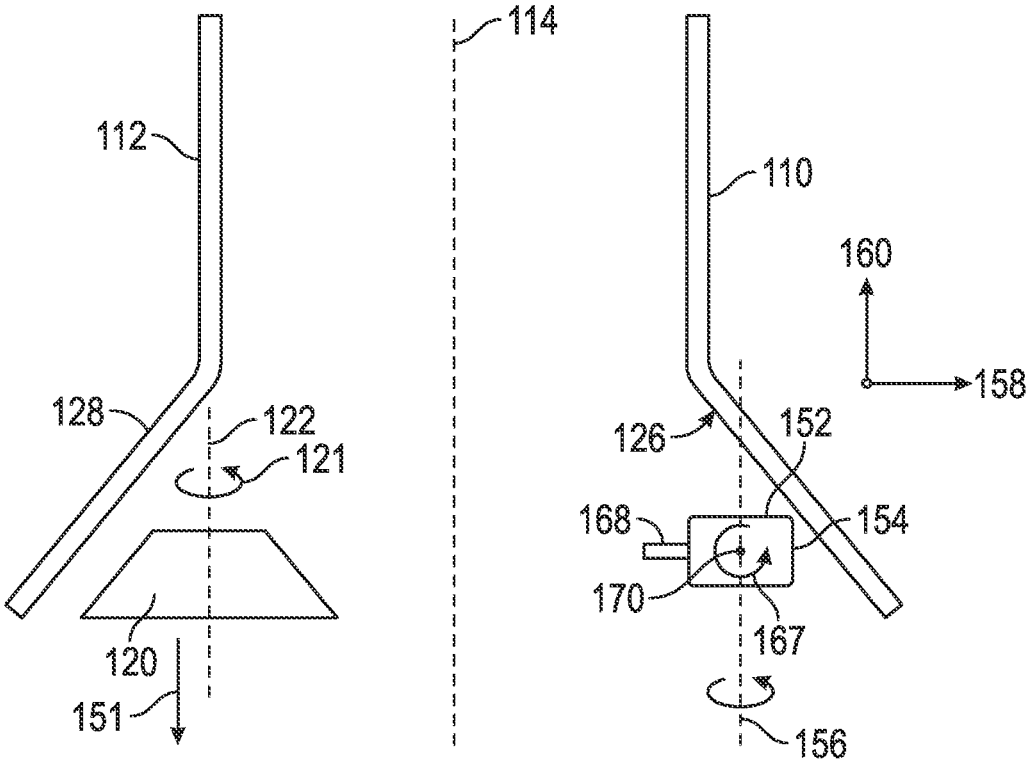
FIGS. 4A-B illustrates a method for roll-forming the lower portion of a cylinder, according to an embodiment.
Figure 4B:
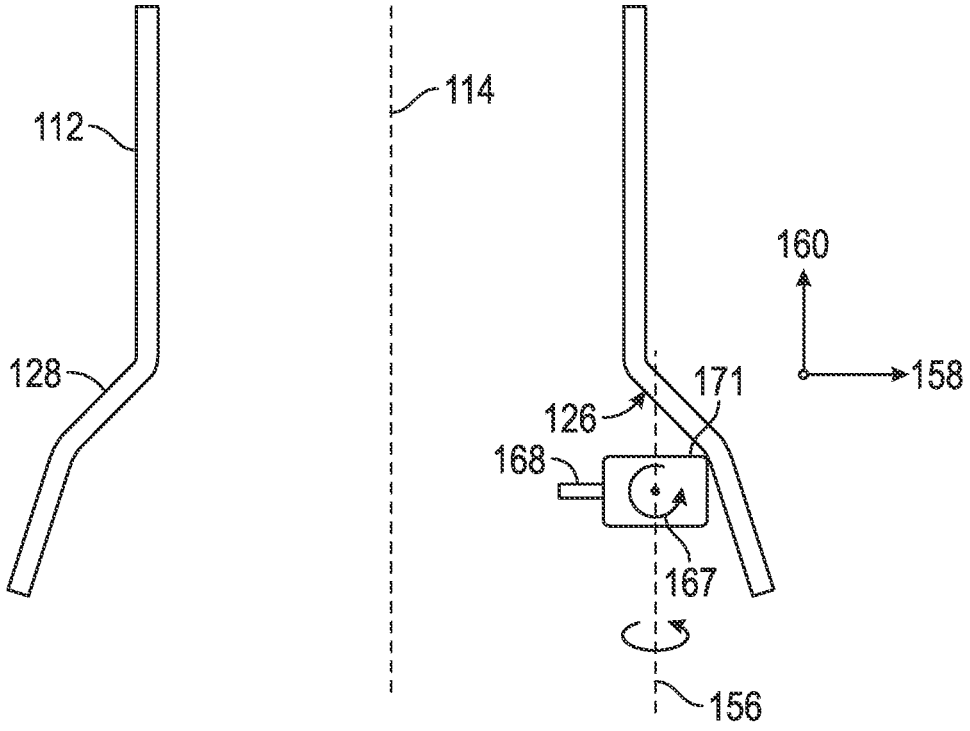

As seen in FIG. 4A, after the spinning roller 120 is withdrawn in direction 151, at least one multi-axis roller 152, with outer surface 154 rotating about axis 156 is moved radially outward and upward (see step 157 of FIG. 1B), as indicated by directional arrows 158, 160 against the inward-facing surface 126 as angled radially outward. The outward movement of the roller 152 as indicated by arrow 158 is perpendicular to the axis of rotation 114 and the movement upward is parallel to the axis of rotation 114 as indicated by arrow 160. The movement of the multi-axis roller 152 in a first instance is accomplished with a pivoting motion 167 that allows the roller 152 to translate as well as rotate. Translation and rotation may take place simultaneously, sequentially, or alternatingly. The translation of the roller 152 is accomplished with a translation drive 168 and the rotation of the roller 152 is accomplished with a rotation drive 170. The combination of the translation drive 168 and the rotation drive 170 allow the roller 152 to effectively pivot during engagement with the inward facing surface 126 and, as seen in FIG. 4B, begin forming the lower portion 128 of the cylinder 112 through contact with the inward facing surface 126 at contact point 171.

Figure 5A:
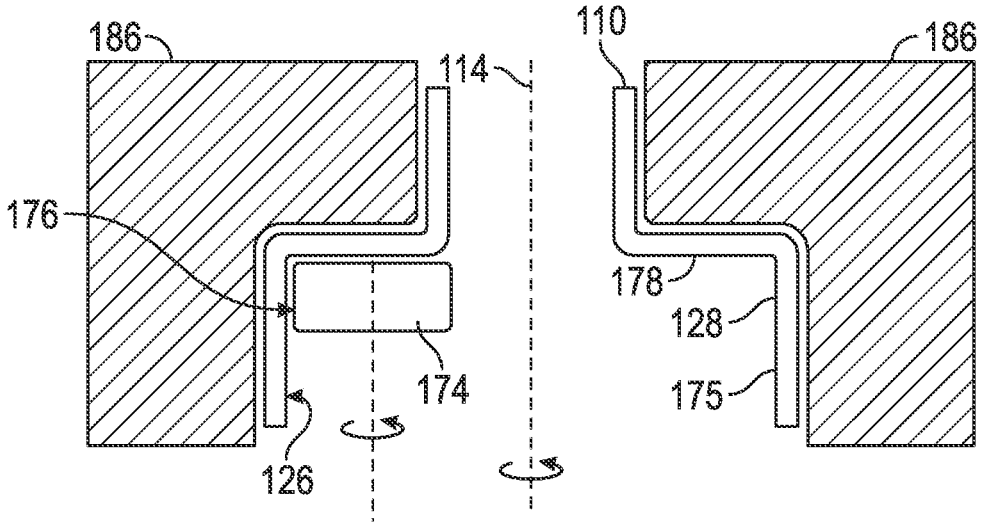
FIGS. 5A-C illustrate a method for using an externally positioned anvil to facilitate progressive roll forming of a cylindrical workpiece, according to an embodiment.
Figure 5B:
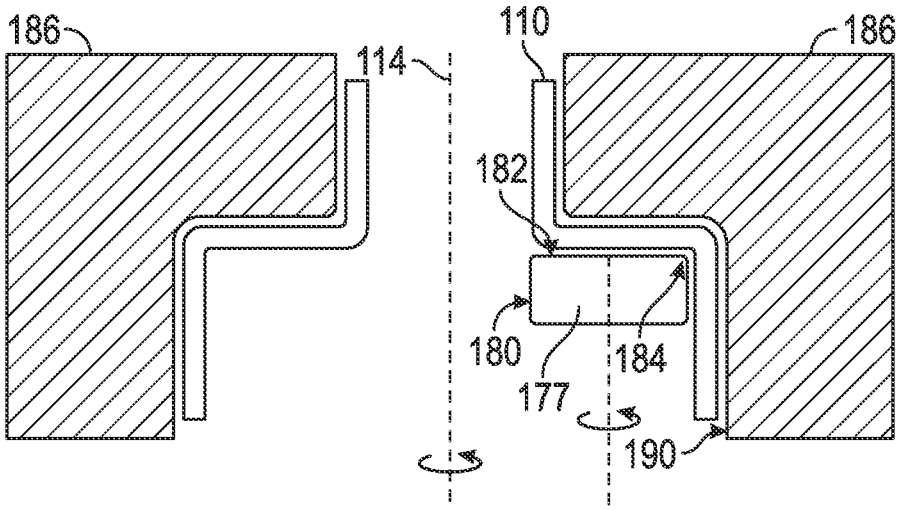

As seen in FIG. 5A, the roll-forming method preferably includes a second method of operation wherein a first multi-axis roller 174 is used to form an initial shape of the cylindrical wall 175 and subsequently using a second multi-axis roller 177 to refine the initial shape of the workpiece 110. The first multi-axis roller 174 preferably includes a first circular edge 176, wherein the forming of an initial shape includes pressing the first circular edge 176 against the inward facing surface 126, as angled radially outward, to bend the lower portion 128 into the cylindrical wall 175 and the ledge 178. The second multi-axis roller 177, as seen in FIG. 5B, may include a cylindrical work surface 180 and a planar top surface 182 connected to each other at a second circular edge 184. In order to refine the initial shape of the workpiece 110, the cylindrical work surface 180 of the second multi-axis roller 176 is pressed against the inward-facing surface 126 of the cylindrical wall and the planar top surface 182 is pressed against the downward facing surface 184 of the ledge 178.

Figure 5C:
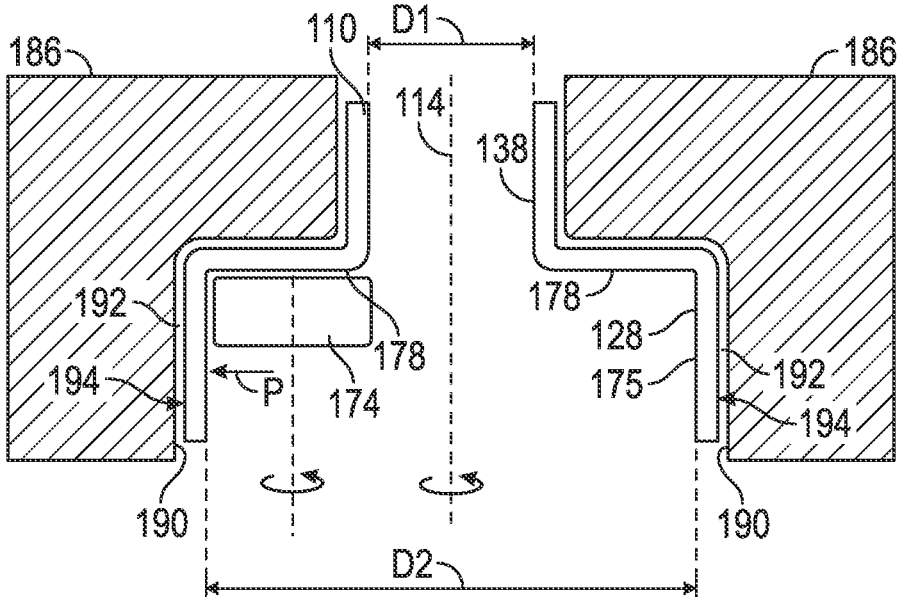

In the method disclosed herein, and as seen at FIG. 5C, the roller 174 presses the lower portion 128 against an anvil 186 positioned around 187 (See FIG. 1B) the cylinder 110 that includes surfaces 190 that define a cavity 192 around the cylinder 110 that are shaped to cooperate with the multi-axis roller 174 to roll-form the lower portion 128 into the cylindrical wall 175 and the ledge 178. The anvil surfaces 190 limit 191 (See FIG. 1B) the outward movement of the cylindrical wall 175 due to the pressure P applied by the roller 174 to the inward facing surface 126. As pressure P is applied by the roller 174, the volume of the cavity 192 is diminished until finally the exterior surface 194 of the cylindrical wall 175 is in contact with the surfaces 190 of the anvil 186. Pressure P is applied by the roller 174 to shape the lower portion 128 into (i) a cylindrical wall 175 having a second diameter D2 that is greater than the first diameter D1 as well as (ii) a ledge 178 connecting the cylindrical wall 175 characterized by the second diameter D2 to an upper portion 138 of the cylinder 110 characterized by the first diameter D1.

Figure 5D:
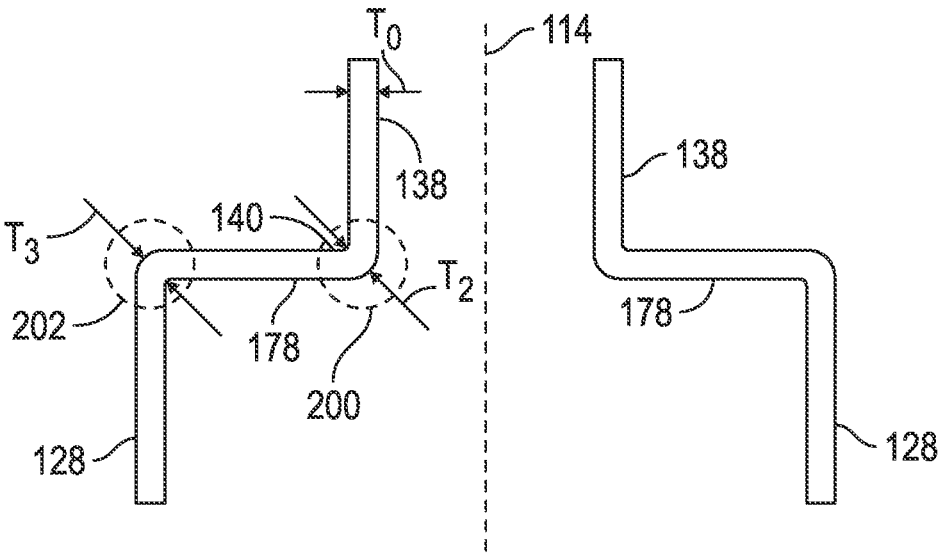
FIG. 5D illustrates a cross-sectional view of a stepped diameter cylinder upon completion of the roll-forming method, according to an embodiment.

Referring now to FIG. 5D, the roll-forming operation just detailed further forms and bends the workpiece 110. For example, the workpiece 110 undergoes additional metal forming 197 (see FIG. 1B) at the bend 200 connecting the ledge 178 to the upper portion 138. In addition, a bend 202 is formed that connects the ledge 178 to the lower portion 128. These bends 200, 202, as seen in FIG. 5D were non-existent prior to the commencement of the roll-forming process and the metal thickness T0 of the entire unformed workpiece is highly consistent throughout. As detailed in FIG. 3, the first roll-forming operation maintains 203 (see FIG. 1B) the wall thickness T1 at the bend 142 in the metal at the circular inflexion line 140 connecting the lower portion 128 and the upper portion 138 to within approximately six percent of the original wall thickness T0 of the cylinder prior to the first forming operation. As seen in FIG. 5D, the wall thicknesses T2, T3 at the bends 200, 202 following the second roll-forming operation are also maintained to within approximately six percent of the original wall thickness T0 of the cylinder 110 prior to the commencement of any forming operation.

Figure 6:
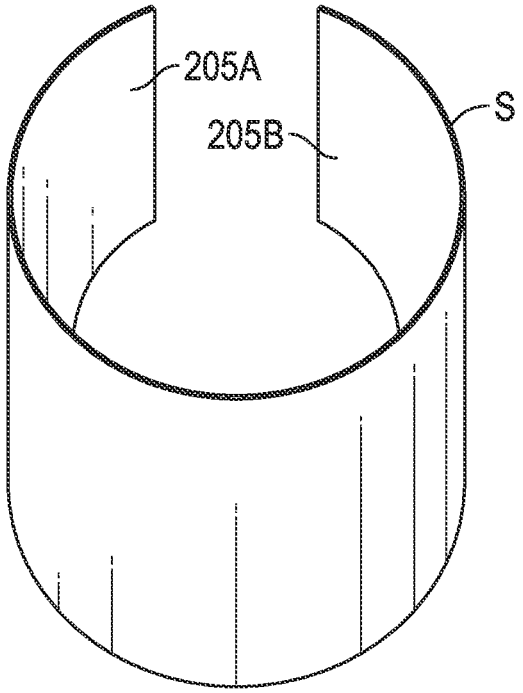
FIG. 6 illustrates a perspective view of a metal sheet with unattached ends, according to an embodiment.
Figure 7:
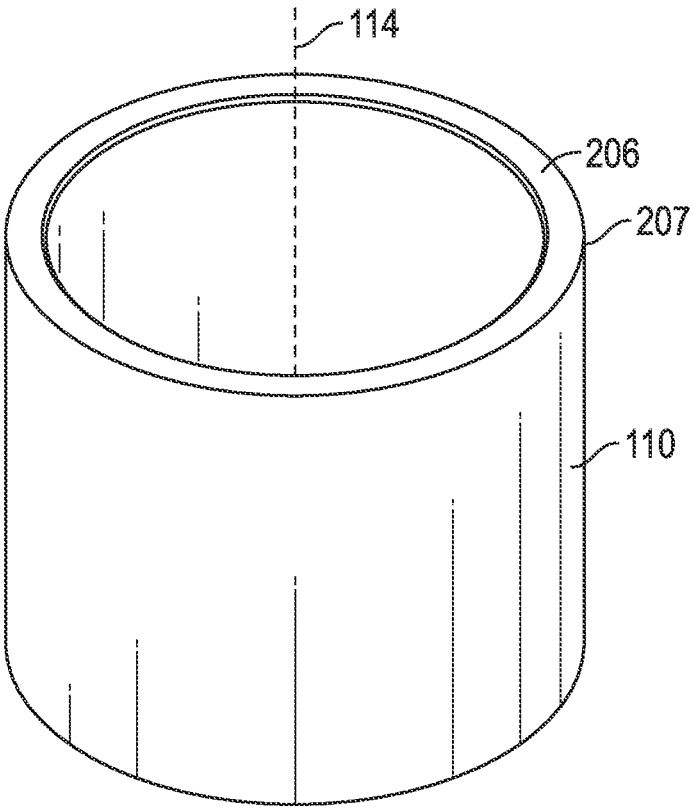
FIG. 7 illustrates a perspective view of the cylinder with an inward rolled lip, according to an embodiment.

The roll-forming method 100 disclosed herein and as detailed in FIG. 6 provides that the cylinder 110 (as seen in FIGS. 1-5) is initially formed from a metal sheet wherein the metal sheet S is bent to contact the opposite ends 205A, 205B of the metal sheet to one other. The opposite ends 205A, 205B are then welded together to form a cylinder. Other methods known in the art could also be used to create cylinder 110. The formed cylinder is roll-formed into a single continuous workpiece that further includes a lip 206, as seen in FIG. 7, at the upper end 207 of the cylinder 110. The lip 206 extends inwards toward the axis 114 of the cylinder 110. The entire roll-forming process is performed on a spinning support that supports the lip 206. The roll forming method disclosed herein is preferably configured for sequentially processing a plurality of instances of the cylinder at a throughput of at least one cylinder per minute, the step of sequentially processing including, for each cylinder, performing the steps of spinning 111, translating 119, and moving 157 among other steps as detailed in FIGS. 1A and 1B.

A Stepped-Diameter Cylinder Produced by Multi-Axis Roll-Forming

Figure 8:
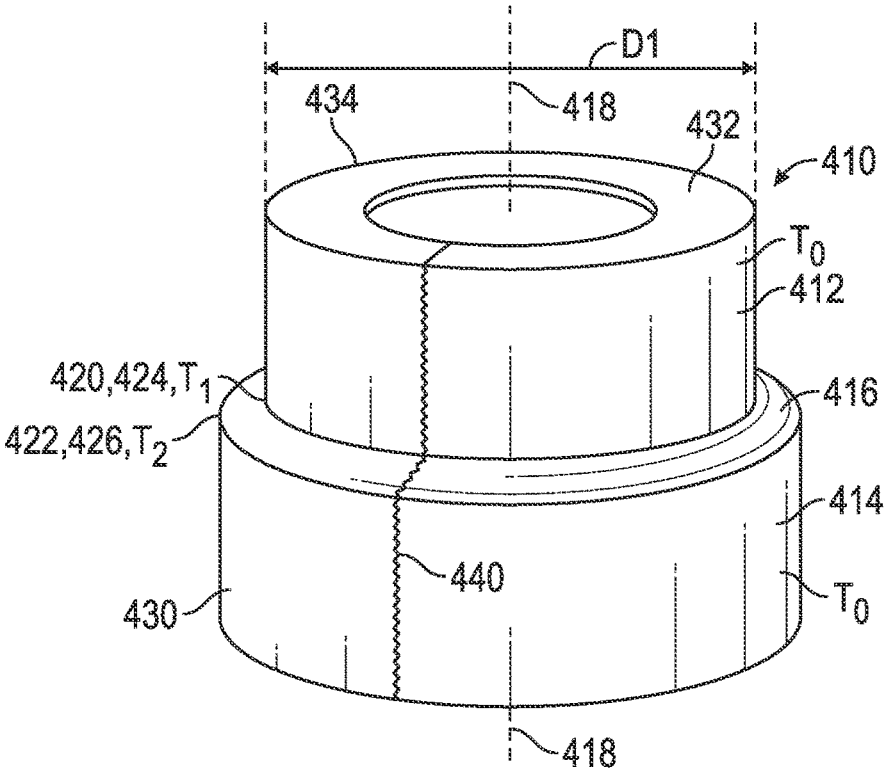
FIG. 8 illustrates a perspective view of the stepped diameter cylinder, according to an embodiment.

The stepped-diameter cylinder 410 fabricated by multi-axis roll-forming as disclosed herein, and depicted at FIG. 8 includes a first cylindrical wall 412 characterized by a first diameter D1 and having a first material thickness T0 prior to the commencement of roll-forming operations. The stepped diameter cylinder 410 includes a second cylindrical wall 414 characterized by a second diameter D2 and having the same material thickness T0 as the first cylindrical wall 412. The second cylindrical wall 414 is concentric with the first cylindrical wall 412.

The stepped diameter cylinder 410 also includes a ledge 416 perpendicular to the cylinder axis 418 of the first cylindrical wall 412 and connecting a bottom edge 420 of the first cylindrical wall 412 with a top edge 422 of the second cylindrical wall 414. The stepped-diameter cylinder 410 also includes a bend 424 between the ledge 416 and the first cylindrical wall 412 having the same material thickness $T_1$ as the first material thickness $T_0$ to within six percent. The bend 426 between the ledge 416 and the second cylindrical wall 414 has same material thickness T2 as the first material thickness $T_0$ to within six percent.

In the stepped-diameter cylinder 410 disclosed herein, the first cylindrical wall 412, the ledge 416, and the second cylindrical wall 414 are respective portions of a single continuous part 430 which may be, for example, a roller-bearing seal case. The stepped-diameter cylinder 410 also includes a lip 432 extending radially inwards from the top edge 434 of the first cylindrical wall 412 in a direction toward the cylinder axis 418. The lip 432 is also a portion of the single continuous part 430. The stepped-diameter cylinder also includes a weld seam 440 spanning the full extent of the single continuous part 430 in a dimension parallel to the cylinder axis 418.

A Multi-Axis Roll-Forming System for Forming a Stepped Diameter in a Cylinder

Figure 9A:
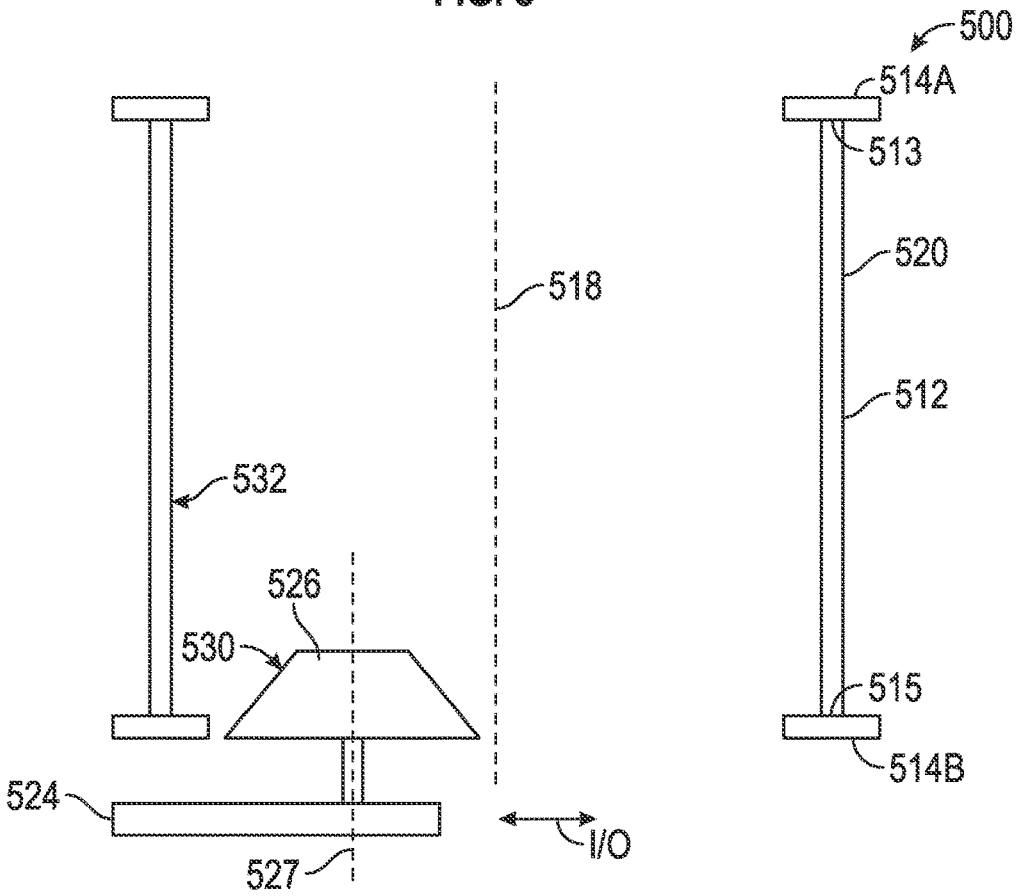
FIG. 9A-E illustrate a system for roll forming a stepped diameter cylinder, according to an embodiment.
Figure 9B:
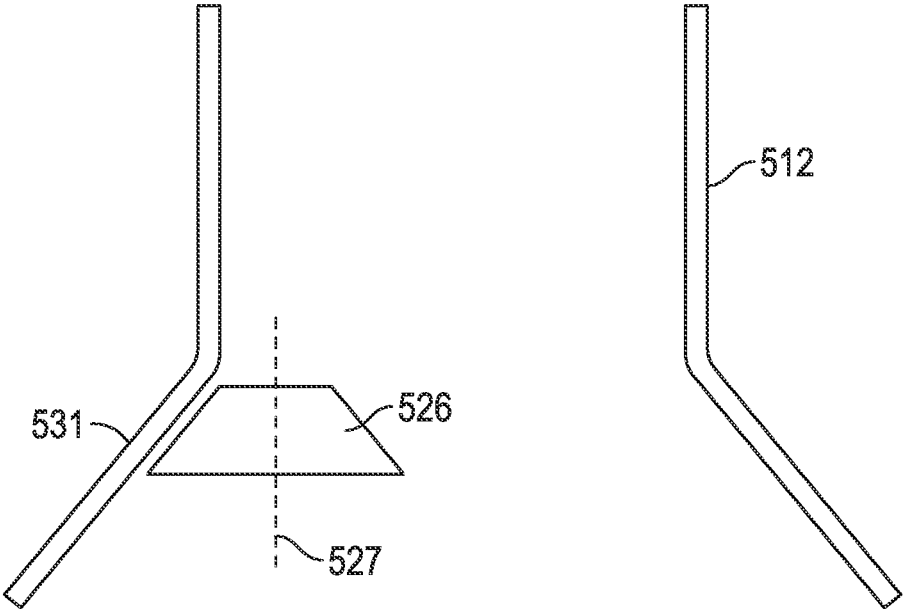

Disclosed herein and as shown in FIG. 9A is a multi-axis roll-forming system 500 for forming a stepped diameter 510 in a cylinder 512. The system 500 includes one or more supports 514A and 514B, which may grip the cylinder from a top edge 513 but preferably supports the cylinder from a bottom edge 515, configured to spin about a rotation axis 518 while supporting a workpiece 520 such as the cylinder 512. A first actuator 524 is configured to translate a first roller 526 in and out as indicated by I/O, perpendicular to the rotation axis 518. The first roller 526, rotating about axis 527, includes a truncated conical work surface 530 configured to press against the inward-facing surface 532 of the cylinder 512 to angle it outward. FIG. 9B details the lower portion 531 of the cylinder 512 canted outward consistent with the outward movement of the first roller 526 against the inward-facing surface 532.

Figure 9C:
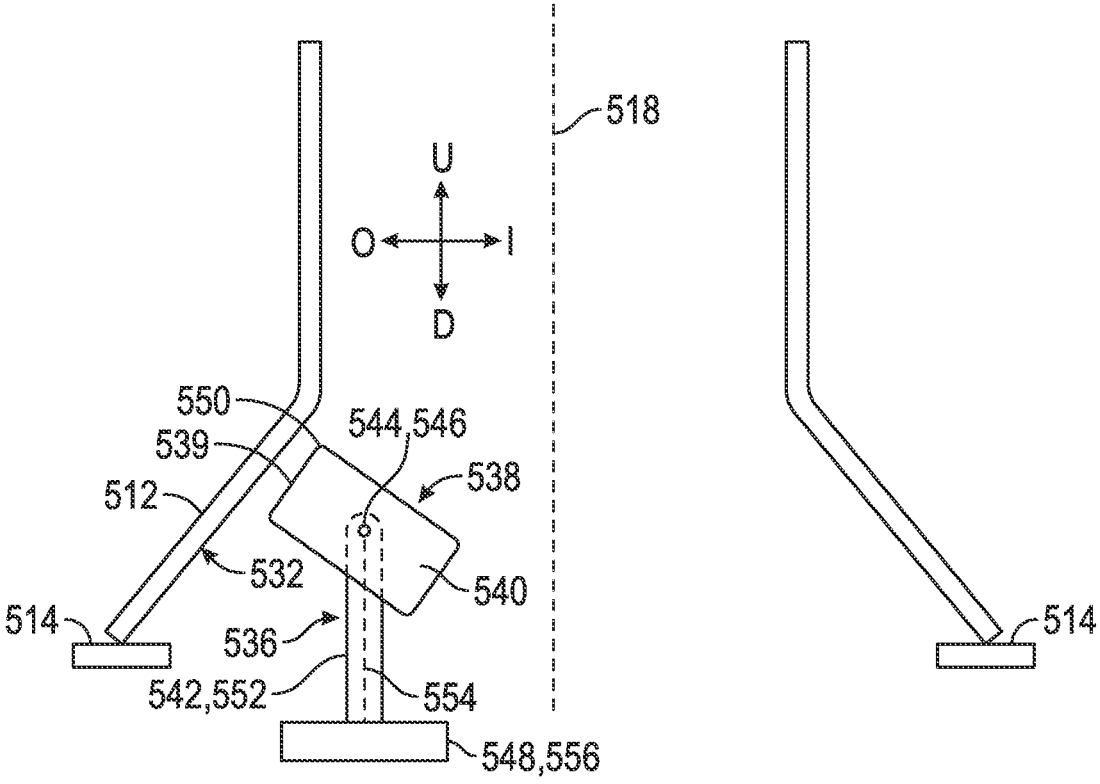

As seen in FIG. 9C, a second actuator 536 is configured to move a multi-axis roller 538 radially outward, relative to the rotation axis 518, and upward along the rotation axis. The second actuator 536 is configured to move the multi-axis roller 538 radially outward O and upward U from a position underneath the support 514 to press with face 539 against the inward-facing surface 532. The multi-axis roller 538 includes a first multi-axis roller 540 to which a first roller arm 542 is coupled. The first roller arm 542 is connected to a pivot joint 544 having a pivot axis 546 that is perpendicular to the rotation axis 518. The second actuator 536 includes a first linear-drive actuator 548 coupled to the first roller arm 542 and configured to extend along the rotation axis 518 to force the first multi-axis roller 540 to pivot about the pivot axis 546. The first multi-axis roller 540 also has a circular edge 550 configured to press against an inward-facing surface 532 of the cylinder 512. Circular edge 550 may be characterized by a ninety-degree angle.

As also seen in FIG. 9C, the first roller arm 542 includes a slider joint 552 that permits up and down U/D translation of the first multi-axis roller 540 along a longitudinal axis 554 of the slider joint 552. The second actuator 536 also includes a second linear-drive actuator 556 capable of translating the first multi-axis roller 540 in the direction perpendicular I/O to the rotation axis 528 when the first linear-drive actuator 548 orients the longitudinal axis 554 perpendicular to the rotation axis 528.

Figure 9D:
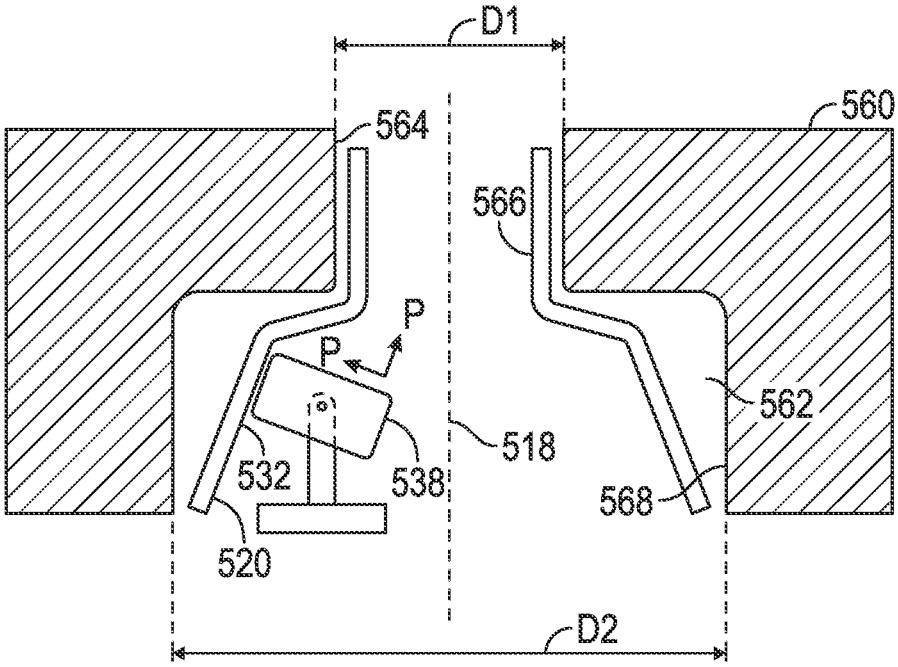
Figure 9E:
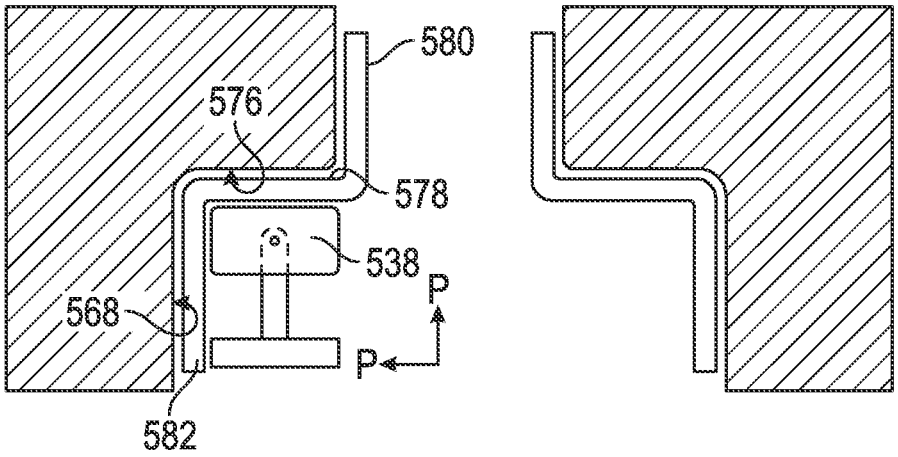

As seen in FIG. 9D, the multi-axis roll-forming system 500 utilizes an anvil 560 for forming a cavity 562 configured to fit over the workpiece 520, the cavity 562 has an upper portion 564 characterized by a first diameter D1 matching the outer diameter 566 of the cylinder 512 and a lower portion 568 adjacent the upper portion 564 and characterized by a second diameter D2 that is greater than the first diameter D1. FIG. 9D reveals the first stage of the roll-forming process using the system 500 disclosed immediately above wherein the multi-axis roller 538 applies pressure P to the inward facing surface 532 of the cylinder 512. The multi-axis roller 538 is configured to expand the diameter of the lower portion 568 of the cylinder 512 positioned in the lower portion 570 of the cavity, to form a stepped-diameter 510 in the cylinder 512. FIG. 9E reveals the multi-axis roller 538 applying pressure Pin an upward and outward direction against the inward facing surface 532 of the cylinder 512.

The pressure applied by the multi-axis roll forming roller 538 pushes the wall of the cylinder 512 against the anvil surfaces 568, 576 forming a cylinder with two separate diameters D1 and D1, and a ledge 578 disposed between the upper portion 580 and the lower portion 582 of the cylinder 512. The ledge 578 is preferably at a ninety degree angle to the upper and lower portions 580, 582; however, other angular configurations are also contemplated by this disclosure. The upper surface 584 of the roller 538 also cooperates in forming the ledge with the application of pressure P to the ledge 578 and against the horizontal anvil surface 576. Without departing from the scope hereof, lower portion 582 may be non-parallel to upper portion 580.

Figure 10:
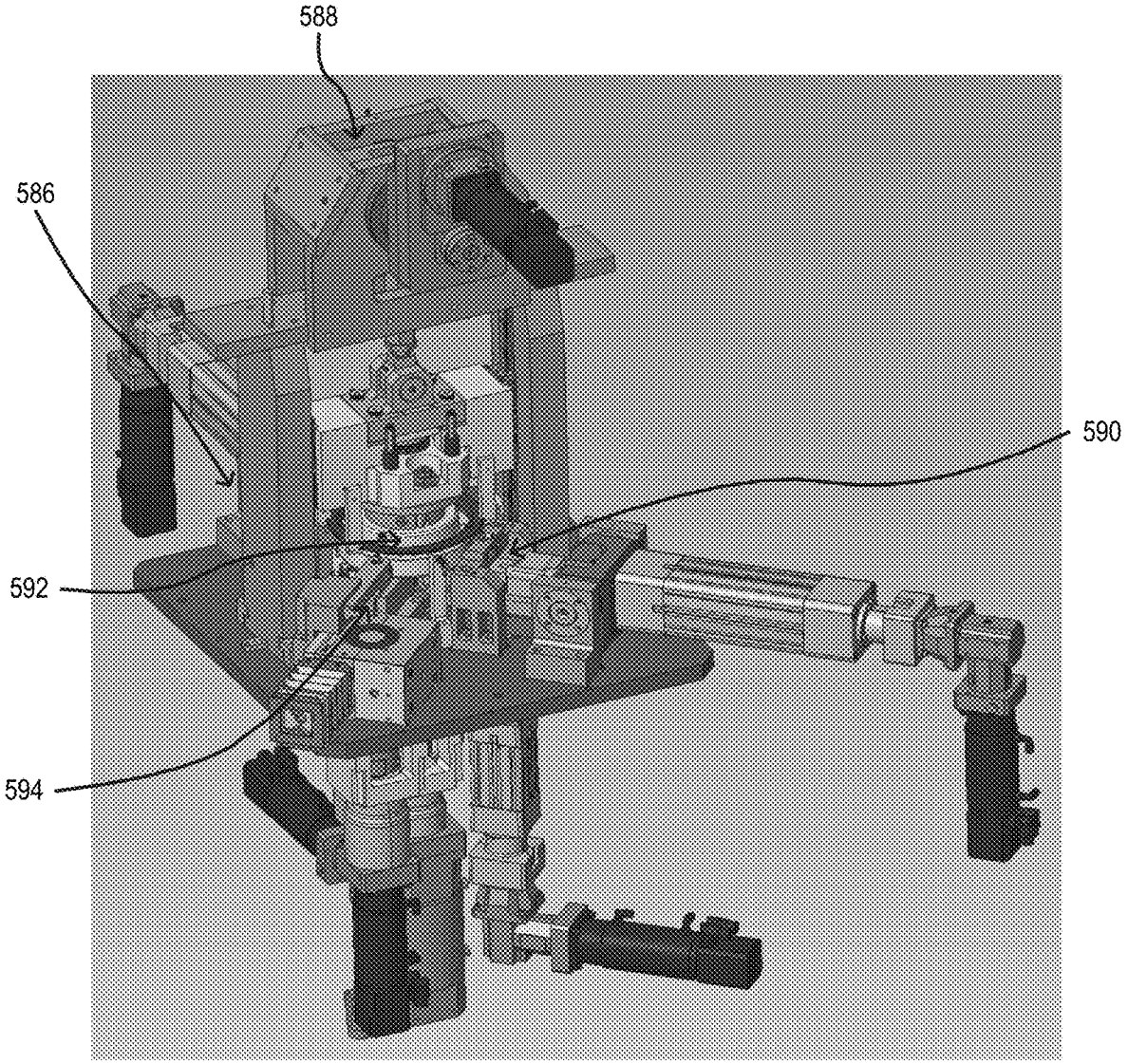
FIG. 10 illustrates a system for roll forming a stepped diameter cylinder, according to an embodiment.

FIG. 10 provides a perspective view of the roll forming system 500 disclosed herein. FIG. 10 reveals the location of the roll forming crank press 586 as well as the multi-axis roller 2 assembly 588. The crank press moves the anvil 186 up linearly along rotation axis 114 to allow for the initial workpiece 110 to be inserted on top of the spin platter 113, then down linearly along rotation axis 114 while stepped cylinder 112 is formed, and then finally up linearly along rotation axis 114 to allow for removal of the completed stepped cylinder 112. Also shown is the location of the multi-axis roller 1 assembly 590 and the form die 592 as well as the linear forming roller assembly 594.

Multi-Axis Roll-Forming Method B

Figure 11:
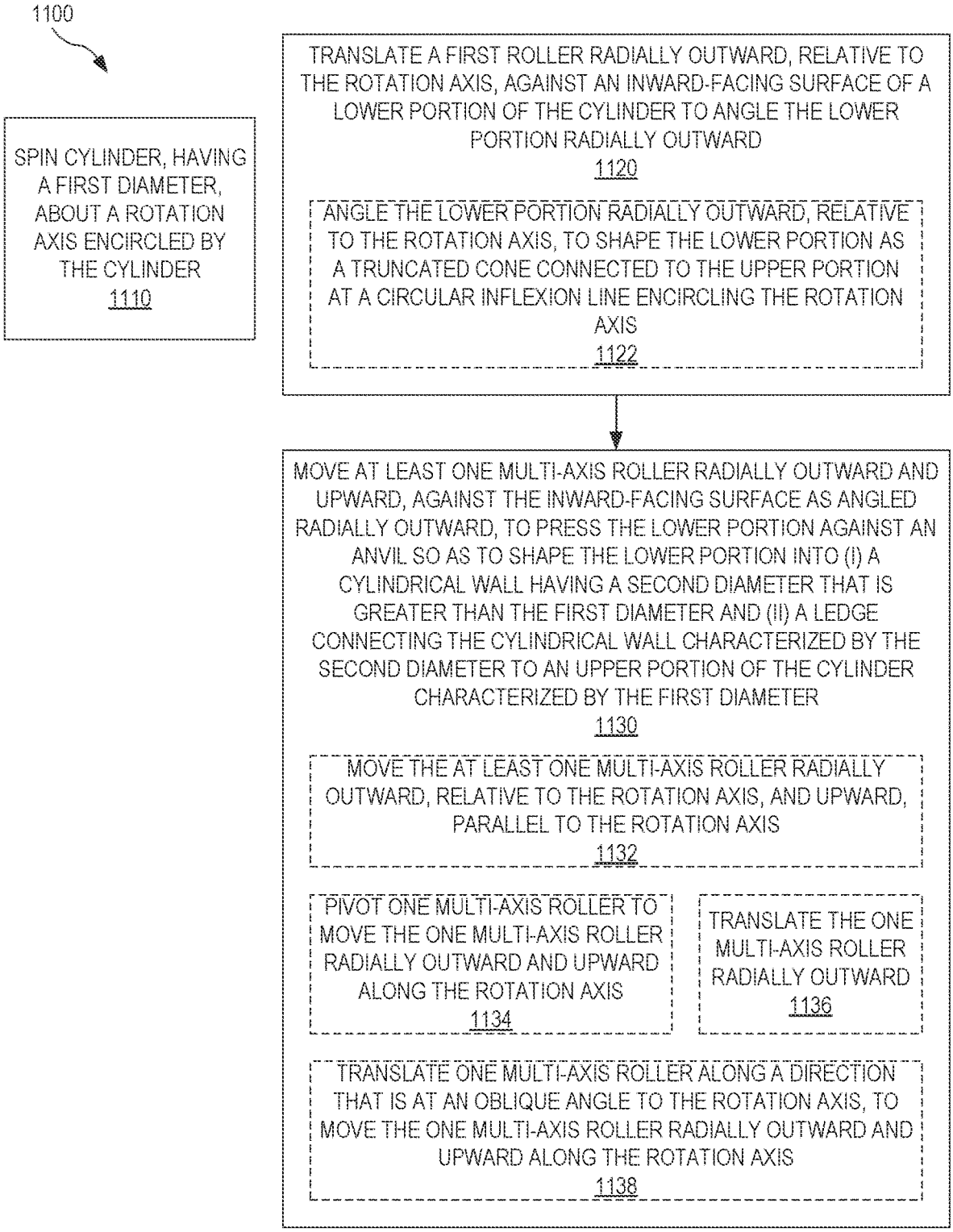
FIG. 11 is a flowchart for another multi-axis roll-forming method for forming a stepped diameter in a cylinder, according to an embodiment.

FIG. 11 is a flowchart for one multi-axis roll-forming method 1100 for forming a stepped diameter in a cylinder. Method 1100 includes a step 1110 of spinning a cylinder, having a first diameter, about a rotation axis encircled by the cylinder. In one example of step 1110, workpiece 112, initially shaped as a cylinder, is spun about rotation axis 114 on spin platter 113, as illustrated in FIG. 2. Method 1100 further includes steps 1120 and 1130. Step 1130 is performed after step 1120, and steps 1120 and 1130 are both performed during step 1110.

Step 1120 translates a first roller radially outward, relative to the rotation axis, against an inward-facing surface of a lower portion of the cylinder to angle the lower portion radially outward. In one example of step 1120, first roller 120 is translated radially outward (relative to rotation axis 114) against inward-facing surface 126 of workpiece 112 to angle a lower portion 128 of workpiece 112 radially outward, as illustrated in FIGS. 2 and 3.

After step 1120, step 1130 moves at least one multi-axis roller radially outward and upward, against the inward-facing surface as angled radially outward, to press the lower portion against an anvil. Step 1130 thereby shapes the lower portion of the workpiece into (i) a cylindrical wall having a second diameter that is greater than the first diameter and (ii) a ledge connecting the cylindrical wall characterized by the second diameter to an upper portion of the cylinder characterized by the first diameter. In one example of step 1130, workpiece 112 with lower portion 128 angled outward as shown in FIG. 4A is placed in anvil 186 of FIG. 5A. Further, in this example, multi-axis roller 152 is moved radially outward and upward, as illustrated in FIGS. 4A and 4B, against inward-facing surface 126 of lower portion 128, to press lower portion 128 against anvil 186 to form the shape depicted in FIG. 5A.

In an embodiment, step 1120 includes a step 1122 of angling the lower portion radially outward, relative to the rotation axis, to shape the lower portion as a truncated cone connected to the upper portion at a circular inflexion line encircling the rotation axis, for example as illustrated for workpiece 112 in FIG. 3.

In an embodiment, step 1130 includes a step 1132 of moving the at least one multi-axis roller radially outward, relative to the rotation axis, and upward, parallel to the rotation axis. In one example of step 1132, roller 168 is moved radially outward and upward.

Step 1130 may include a step 1134 of pivoting one multi-axis roller to move the one multi-axis roller radially outward and upward along the rotation axis. In one example of step 1134, roller 538 is pivoted as illustrated in FIGS. 9C and 9D. Step 1130 may further include a step 1136, performed during step 1134, of translating the one multi-axis roller radially outward. In one example of step 1136, roller 538 is translated as illustrated in FIG. 9E.

In certain embodiments, step 1130 includes a step 1138 of translating one multi-axis roller along a direction that is at an oblique angle to the rotation axis. In one example of step 1138, roller 538 is translated at an oblique angle from an initial position, via the position shown in FIG. 9D, to the position shown in FIG. 9E.

Figure 12:
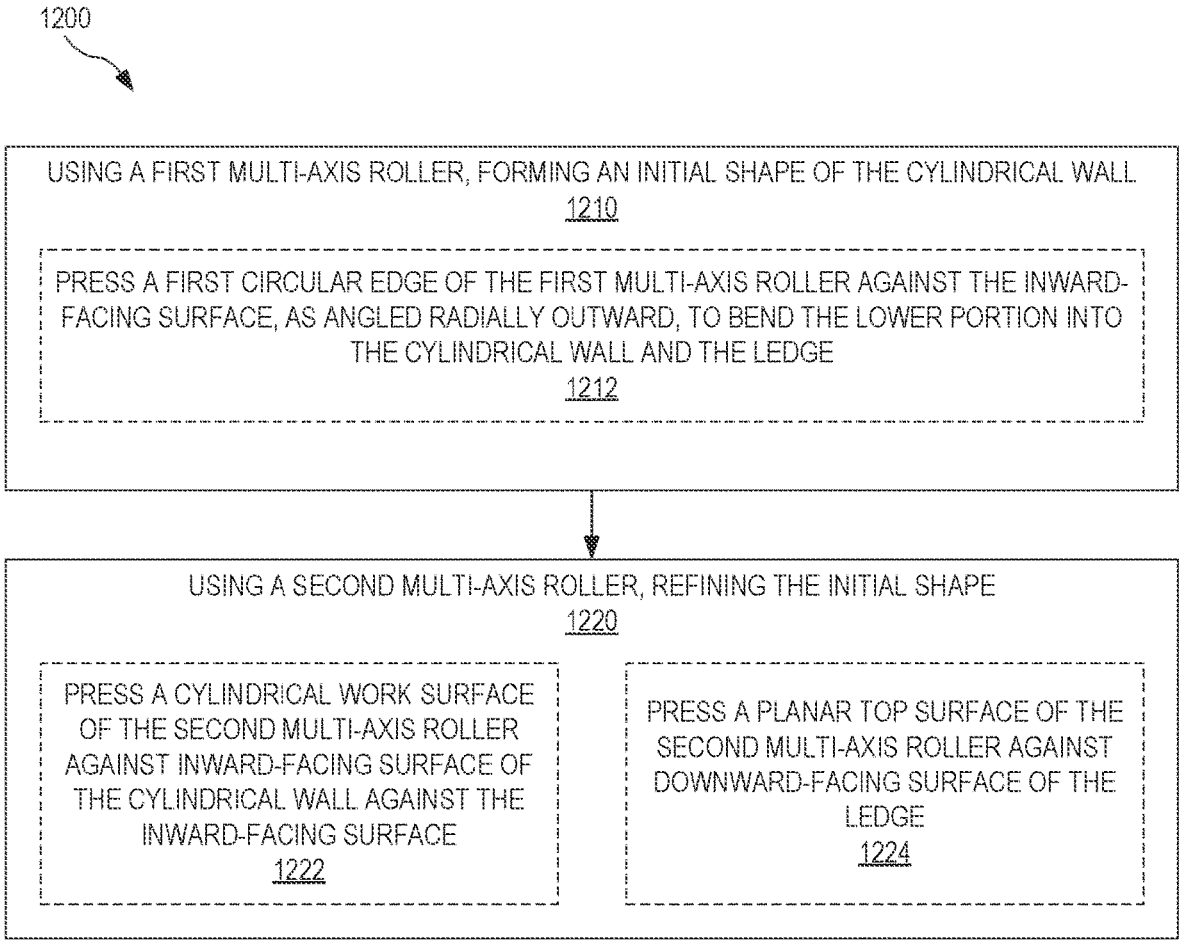
FIG. 12 is a flowchart of a method for forming a stepped-diameter cylinder from a workpiece having an upper cylindrical portion and a lower portion that is angled outward from the upper cylindrical portion, according to an embodiment.

FIG. 12 is a flowchart for one method 1200 for forming a stepped-diameter cylinder from a workpiece having an upper, cylindrical portion and a lower portion that is angled outward from the upper, cylindrical portion. Method 1200 may be implemented in step 1130 of method 1100. Method 1200 includes steps 1210 and 1220. Step 1210 uses a first multi-axis roller to form, from the lower outward-angled portion, an initial shape of the cylindrical wall discussed above in reference to step 1130 of method 1100. Subsequently, step 1220 uses a second multi-axis roller to refine the initial shape. In one example of method 1200, step 1210 uses roller 174 (as shown in FIG. 5A, and step 1220 uses roller 177 (as shown in FIG. 5B). In another example of method 1200, step 1210 uses roller 168 (as shown in FIGS. 4A and 4B) or roller 538 (as shown in FIGS. 9C-9E), and step 1220 uses roller 177 (as shown in FIG. 5B).

Combinations of Features

Features described above as well as those claimed below may be combined in various ways without departing from the scope hereof. For example, it will be appreciated that aspects of one multi-axis roll-forming method, system, or product, described herein, may incorporate features or swap features of another multi-axis roll-forming method, system, or product described herein. The following examples illustrate some possible, non-limiting combinations of embodiments described above. It should be clear that many other changes and modifications may be made to the methods, products, and systems herein without departing from the spirit and scope of this invention:

(A1) One multi-axis roll-forming method for forming a stepped diameter in a cylinder includes spinning the cylinder about a rotation axis encircled by the cylinder, the cylinder having a first diameter. The method further includes, during the step of spinning, (a) translating a first roller radially outward, relative to the rotation axis, against an inward-facing surface of a lower portion of the cylinder to angle the lower portion radially outward, and (b) after the step of translating, moving at least one multi-axis roller radially outward and upward, against the inward-facing surface as angled radially outward, to press the lower portion against an anvil so as to shape the lower portion into (i) a cylindrical wall having a second diameter that is greater than the first diameter and (ii) a ledge connecting the cylindrical wall characterized by the second diameter to an upper portion of the cylinder characterized by the first diameter.

(A2) In the multi-axis roll-forming method denoted as (A1), the lower portion may be associated with a lower segment of the rotation axis, and the step of moving may include moving the at least one multi-axis roller radially outward, relative to the rotation axis, and upward, parallel to the rotation axis.

(A3) In either of the multi-axis roll-forming methods denoted as (A1) and (A2), the step of translating a first roller may include angling the lower portion radially outward, relative to the rotation axis, to shape the lower portion as a truncated cone connected to the upper portion at a circular inflexion line encircling the rotation axis.

(A4) In the multi-axis roll-forming method denoted as (A3), a surface of the first roller, contacting the lower portion in the step of translating, may be conical.

(A5) In any of the multi-axis roll-forming methods denoted as (A1) through (A4), the step of translating may include maintaining a material thickness at the bend connecting the lower portion and the upper portion to within six percent of the original material thickness of the cylinder prior to the step of translating.

(A6) In the multi-axis roll-forming method denoted as (A5), the step of moving may include maintaining, at the bend and to within six percent, the original material thickness.

(A7) In any of the multi-axis roll-forming methods denoted as (A1) through (A16), the step of moving may include pivoting one multi-axis roller to move the one multi-axis roller radially outward and upward along the rotation axis.

(A8) In the multi-axis roll-forming method denoted as (A7), the step of moving may further include, during the step of pivoting, translating the one multi-axis roller radially outward.

(A9) In either of the multi-axis roll-forming methods denoted as (A7) and (A8), the step of pivoting may include actuating a translation drive to effect said pivoting.

(A10) In either of the multi-axis roll-forming methods denoted as (A7) and (A8), the step of pivoting may include actuating a rotation drive to effect said pivoting.

(A11) In any of the multi-axis roll-forming methods denoted as (A1) through (A10), the step of moving may include translating one multi-axis roller along a direction that is at an oblique angle to the rotation axis, to move the one multi-axis roller radially outward and upward along the rotation axis.

(A12) In any of the multi-axis roll-forming methods denoted as (A1) through (A11), the step of moving may include actuating a first translation drive that translates one multi-axis roller radially outward, and actuating a second translation drive that translates the one multi-axis roller in direction parallel to the rotation axis.

(A13) In any of the multi-axis roll-forming methods denoted as (A1) through (A12), the step of moving may include using a first multi-axis roller to form an initial shape of the cylindrical wall and, subsequently, using a second multi-axis roller to refine the initial shape.

(A14) In the multi-axis roll-forming method denoted as (A13), the first multi-axis roller may include a first circular edge, and the step of forming an initial shape may include pressing the first circular edge against the inward-facing surface, as angled radially outward, to bend the lower portion into the cylindrical wall and the ledge.

(A15) In the multi-axis roll-forming method denoted as (A13), the second multi-axis roller may include a cylindrical work surface and a planar top surface connected to each other at a second circular edge, and the step of refining may include (a) pressing the cylindrical work surface against inward-facing surface of the cylindrical wall against the inward-facing surface and (b) pressing the planar top surface against downward-facing surface of the ledge.

(A16) In any of the multi-axis roll-forming methods denoted as (A1) through (A12), the step of may include comprising pressing a circular edge of the multi-axis roller against the inward-facing surface, as angled radially outward, to bend the lower portion into the cylindrical wall and the ledge.

(A17) In any of the multi-axis roll-forming methods denoted as (A1) through (A16), the cylinder may be part of a single continuous workpiece that further includes a lip at upper end of the cylinder, wherein the lip extends inwards toward axis of the cylinder, and the step of spinning may include spinning a support that supports the lip.

(A18) In any of the multi-axis roll-forming methods denoted as (A1) through (A17), the anvil may include surfaces that define a cavity around the cylinder and are shaped to cooperate with the at least one multi-axis roller to shape the lower portion into the cylindrical wall and the ledge.

(A19) Any of the multi-axis roll-forming methods denoted as (A1) through (A18) may further include sequentially processing a plurality of instances of the cylinder at a throughput of at least one cylinder per minute, wherein the step of sequentially processing includes, for each cylinder, performing the steps of spinning, translating, and moving.

(A20) Any of the multi-axis roll-forming methods denoted as (A1) through (A19) may further include roll-forming the cylinder from a metal sheet, and the step of roll-forming may include (a) bending the metal sheet to contact two opposite ends of the metal sheet to each other and (b) welding the two opposite ends together.

(B1) One stepped-diameter cylinder produced by multi-axis roll-forming includes (a) a first cylindrical wall characterized by a first diameter and having a first material thickness, (b) a second cylindrical wall characterized by a second diameter and having the first material thickness, wherein the second cylindrical wall is concentric with the first cylindrical wall, and (c) a ledge perpendicular to cylinder axis of the first cylindrical wall and connecting a bottom edge of the first cylindrical wall with a top edge of the second cylindrical wall, wherein a bend between the ledge and the first cylindrical wall has the same material thickness as the first material thickness to within six percent, and wherein the first cylindrical wall, the ledge, and the second cylindrical wall are respective portions of a single continuous part.

(B2) The stepped-diameter cylinder denoted as (B1) may be at least part of a roller-bearing seal case.

(B3) In either of the stepped-diameter cylinders denoted as (B1) and (B2), the bend may have same material thickness as the first material thickness to within six percent.

(B4) Any of the stepped-diameter cylinders denoted as (B1) through (B3) may further include a lip extending radially inwards from top edge of the first cylindrical wall in direction toward the cylinder axis, wherein the lip is a further portion of the single continuous part.

(B5) Any of the stepped-diameter cylinders denoted as (B1) through (B4) may have a weld seam spanning full extent of the single continuous part in dimension parallel to the cylinder axis.

(C1) One multi-axis roll-forming system, for forming a stepped diameter in a cylinder, includes (a) a support configured to spin about a rotation axis while supporting a workpiece including a cylinder, (b) a first actuator configured to translate a first roller perpendicular to rotation axis, and (c) at least one second actuator configured to move at least one multi-axis roller radially outward, relative to the rotation axis, and upward along the rotation axis.

(C2) In the multi-axis roll-forming system denoted as (C1), the first actuator may be configured to translate the first roller radially outward, relative to the rotation axis, from a position underneath the support, to press against an inward-facing surface of a lower portion of the cylinder extending below the support, and the at least one second actuator may be configured to move the at least one multi-axis roller radially outward and upward from a position underneath the support, to press against the inward-facing surface.

(C3) In any of the multi-axis roll-forming systems denoted as (C1) through (C2), the at least one multi-axis roller may include a first multi-axis roller, the multi-axis roll-forming system may further include a first roller arm to which the first multi-axis roller is coupled, wherein the first roller arm is connected to a pivot joint having a pivot axis that is perpendicular to the rotation axis, and the at least one second actuator may include a first linear-drive actuator coupled to the first roller arm and configured to extend along the rotation axis to force the first multi-axis roller to pivot about the pivot axis.

(C4) In the multi-axis roll-forming system denoted as (C3), the first roller arm may include a slider joint permitting translation of the first multi-axis roller along a longitudinal axis of the slider joint, and the at least one second actuator may further include a second linear-drive actuator capable of translating the first multi-axis roller in direction perpendicular to the rotation axis when the first linear-drive actuator orients the longitudinal axis perpendicular to the rotation axis (C5) In either of the multi-axis roll-forming systems denoted as (C3) and (C4), the at least one multi-axis roller may include a second multi-axis roller, and the at least one second actuator may further include a second linear-drive actuator configured to translate the second multi-axis roller in direction perpendicular to the rotation axis.

(C6) In any of the multi-axis roll-forming systems denoted as (C1) through (C5), the at least one multi-axis roller may include a first multi-axis roller having a circular edge configured to press against an inward-facing surface of the cylinder.

(C7) The multi-axis roll-forming system denoted as (C6) may further include the first roller, and the first roller may include a truncated conical work surface configured to press against the inward-facing surface to angle it outward according to slant angle of the truncated conical work surface.

(C8) Any of the multi-axis roll-forming systems denoted as (C1) through (C7) may further include an anvil forming a cavity configured to fit over the workpiece, wherein the cavity has (a) an upper portion characterized by a first diameter matching outer diameter of the cylinder and (b) a lower portion adjacent the upper portion and characterized by a second diameter that is greater than the first diameter, and wherein the at least one multi-axis roller is cooperatively configured to expand diameter of a lower portion of the cylinder positioned in the lower portion of the cavity, to form a stepped-diameter cylinder from the cylinder.

Changes may be made in the above systems and methods without departing from the scope hereof. It should thus be noted that the matter contained in the above description and shown in the accompanying drawings should be interpreted as illustrative and not in a limiting sense. The following claims are intended to cover generic and specific features described herein, as well as all statements of the scope of the present systems and methods, which, as a matter of language, might be said to fall therebetween.

What is claimed is:

1. A roll-forming system, comprising:

a spin platter configured to spin about a rotation axis while supporting a cylindrical shell that is co-axial with the rotation axis, the cylindrical shell having an initial diameter;

a first roller configured to translate radially outward, relative to the rotation axis, against an inward-facing surface of a lower portion of the cylindrical shell to angle the lower portion radially outward, the first roller being rotatable only about an axis that is parallel to the rotation axis of the spin platter;

an anvil configured to surround the cylindrical shell; and a second roller configured to translate radially outward and axially upward against the inward-facing surface, as angled radially outward, to press the lower portion against the anvil to shape the lower portion into (i) a cylindrical wall having an expanded diameter that is greater than the initial diameter and (ii) a ledge connecting the cylindrical wall to an upper portion of the cylindrical shell;

wherein:

the second roller has a cylindrical face that is rotatable about a roller axis;

the second roller is pivotable about a pivot axis that is perpendicular to the rotation axis and radially displaced from the rotation axis; and the second roller, when translated radially outward and axially upward, pivots about the pivot axis such that the cylindrical face presses against the inward facing surface, as angled radially outward.

2. The roll-forming system of claim 1, further comprising:

a first actuator configured to translate the first roller radially outward, the first actuator being located underneath the spin platter; and a second actuator configured to translate the second roller radially outward and axially upward, the second actuator being located underneath the spin platter.

3. The roll-forming system of claim 1, wherein:

the first roller is shaped as a truncated cone having a slant angle relative to the rotation axis; and the first roller presses against the inward-facing surface to angle the first portion at the slant angle.

4. The roll-forming system of claim 3, the anvil forming a cylindrically symmetric cavity having:

an upper-cavity portion having the initial diameter such that the upper portion of the cylindrical shell can fit therein;

a lower-cavity portion axially adjacent the upper-cavity portion and having the expanded diameter; and a cavity ledge that radially connects the upper-cavity portion and the lower-cavity portion.

5. The roll-forming system of claim 4, wherein the cavity ledge forms a right angle with the lower-cavity portion.

6. The roll-forming system of claim 5, wherein the second roller, when translated axially upward to push the lower portion against the cavity ledge, pivots about the pivot axis such that the roller axis is parallel to the rotation axis of the spin platter.

7. The roll-forming system of claim 4, wherein the cavity ledge forms an angle with the lower-cavity portion that is not a right angle.

8. The roll-forming system of claim 1, wherein one or both of:

the lower portion of the cylindrical shell and the ledge form a first bend whose thickness is within six percent of an original material thickness of the cylindrical shell; and the upper portion of the cylindrical shell and the ledge form a second bend whose thickness is within six percent of the original material thickness of the cylindrical shell.

9. The roll-forming system of claim 1, wherein:

the ledge forms a 90° angle with the cylindrical wall; and the ledge forms a 270° angle with the upper portion of the cylindrical shell.

* * * * *